United States Patent [19]

Lozfau et al.

[11] Patent Number: 4,522,526

[45] Date of Patent: Jun. 11, 1985

[54] RING MECHANISM FOR LOOSE LEAF BINDERS AND METHOD OF MANUFACTURE THEREFOR

[75] Inventors: Arthur Lozfau, Belchertown; William H. Lucey, Holyoke, both of Mass.

[73] Assignee: Dennison National Company, Holyoke, Mass.

[21] Appl. No.: 392,559

[22] Filed: Jun. 28, 1982

[51] Int. Cl.[3] ..... B42F 13/00; B42F 13/22; B42F 3/04; B42F 13/36

[52] U.S. Cl. ..... 402/37; 402/38; 402/40; 402/41

[58] Field of Search ..... 402/38, 40, 37, 41

[56] References Cited

U.S. PATENT DOCUMENTS

| | | | |
|---|---|---|---|
| Re. 18,806 | 4/1933 | Dawson | 402/40 |
| 1,529,454 | 3/1925 | Trussell | 402/38 |
| 1,900,334 | 3/1933 | Dawson | 402/37 |
| 2,013,552 | 9/1935 | Dawson | 402/38 |
| 2,439,675 | 4/1948 | Segal | 402/38 |
| 2,817,341 | 12/1957 | Schade | 402/38 |
| 3,404,685 | 10/1968 | Vernon | 402/41 |
| 3,884,586 | 5/1975 | Michaelis | 402/38 |

*Primary Examiner*—Paul A. Bell
*Assistant Examiner*—Paul M. Heyrana, Sr.
*Attorney, Agent, or Firm*—Chapin, Neal & Dempsey

[57] ABSTRACT

Ring mechanism for loose leaf binders, and method of manufacture therefor, which has actuating or booster levers which serve both to open and close the rings. Mating ring segments or portions are affixed at corresponding spaced locations to a pair of metallic rods or rails. The outer ends of the rods of oval cross section include crank arm portions, with flattened tangs at the terminal ends thereof formed during fabrication on a rail of continuous length which is then severed to provide identical rail and ring segment components. The rail and ring components are then assembled in parallel relation within the inturned edge channels of a spring metal cover plate or case of arcuate cross section which is tensioned to hold the ring segments in closed relation. Each of the booster levers is slotted to engage opposite surfaces of the tangs for pivoting the rods about their longitudinal axes in response to pivotal movement of the booster levers whereby the rings are selectively opened and closed by said levers.

5 Claims, 8 Drawing Figures

RING MECHANISM FOR LOOSE LEAF BINDERS AND METHOD OF MANUFACTURE THEREFOR

BACKGROUND OF THE INVENTION

This invention relates to ring mechanisms for loose leaf binders with booster or actuating levers which operate both to open and close the binder rings. In the most widely accepted commercial version, such double acting mechanisms have generally involved the use of flat toggle or hinge plates such, for example, as disclosed in U.S. Pat. Nos. 2,061,676 and 3,884,586. In this type of mechanism, an operating lever directly engages the ends of the toggle plates for pivotable movement thereof in opening and closing the rings.

Ring binder mechanisms have also been constructed by attaching the ring segments to parallel rods or wire rails instead of toggle plates as discussed above. In one well-known commerical version of this latter type of ring mechanism, the operating levers or boosters, which engage the rings per se, serve to open the rings only. To close the rings, it is necessary to squeeze the ring halves together manually. This is considered a distinct commercial drawback in comparison with toggle plate type mechanisms, which are readily opened and closed using the booster levers.

In the prior patent art, U.S. Pat. No. 2,013,552 discloses one type of wire rail ring mechanism in which the rings are opened with a lever, but must be closed by hand. U.S. Pat. No. 3,404,685 shows a binder mechanism of the rail type in which the booster levers directly engage the rings per se to open and close the same. In this mechanism, the distance from its fulcrum to the point of engagement with the rings is relatively long. Thus, to provide a suitable mechanical advantage for easy operation, a relatively long lever arm is required. In addition, the lever is pivoted on the fastening rivet for opening the rings and on separate legs to close the rings. This construction is relatively cumbersome and complicated in comparison with the toggle plate type mechanism. Other than the toggle plate type mechanisms, which are invariably pivoted in opposite directions by booster levers, there have heretofore been no known ring mechanisms of the wire rail type wherein the booster levers engage the rails directly the rotate the same in opposite directions.

It is the principal object of the present invention to provide a ring mechanism for loose leaf binders in which the operating rings are carried on wire rails, which are adapted, to be directly rotated in opposite directions by booster levers to both open and close the rings in the manner of a toggle plate mechanism.

It is another object of this invention to provide a ring mechanism of the above type in which the construction of the wire rails are such as to be readily adapted to mass production techniques.

It is a further object of this invention to provide an improved method of manufacturing ring mechanisms of the above type which is simple, efficient and economical.

The above and other objects and advantages of this invention will be more readily apparent from a reading of the following description in view of the accompanying drawings, in which.

Figure 1:
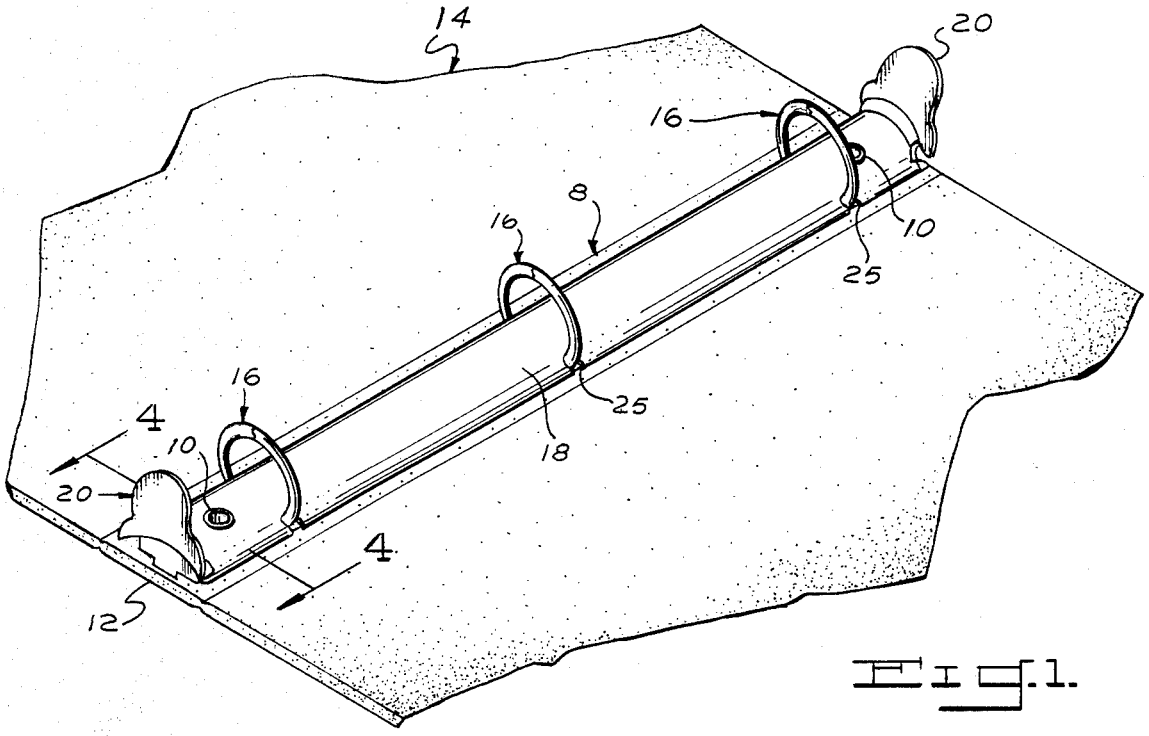
FIG. 1 is a perspective view of a ring binder mechanism of the type embodying this invention.

Referring in detail to the drawings in which a ring mechanism of the type embodying this invention is shown generally at 8 in FIG. 1, the mechanism is illustrated as affixed, as by fasteners, such as rivets 10, to the spine of back panel 12 of a suitable binder cover 14.

The mechanism comprises, in general, a plurality of longitudinally spaced rings 16 of typical split ring construction, a spring metal case or cover plate 18 and a pair of booster or actuating levers 20, one disposed at each end of the ring mechanism. The split rings 16 are adapted to be opened and closed about the longitudinal axis of the ring mechanism by pivotable movement of the booster levers 20 about axes transverse the longitudinal axis of the mechanism.

Figure 2:
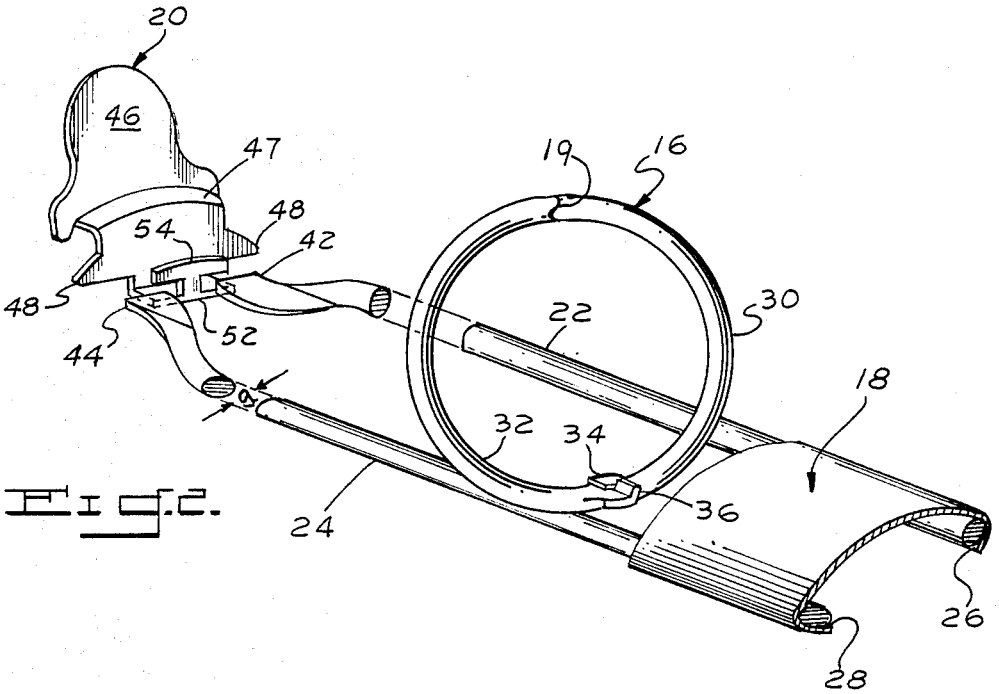
FIG. 2 is a perspective view of a portion of the ring mechanism shown in FIG. 1 with portions cut away to reveal its internal construction.
Figure 3:
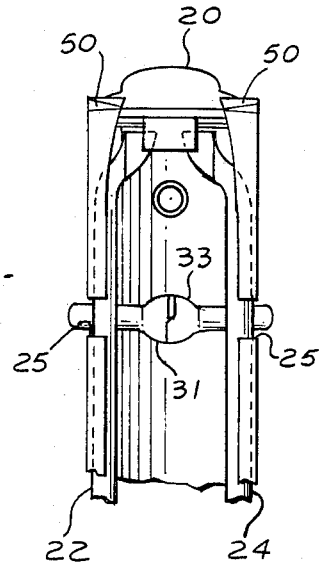
FIG. 3 is a partial bottom plan view of the mechanism.
Figure 4:
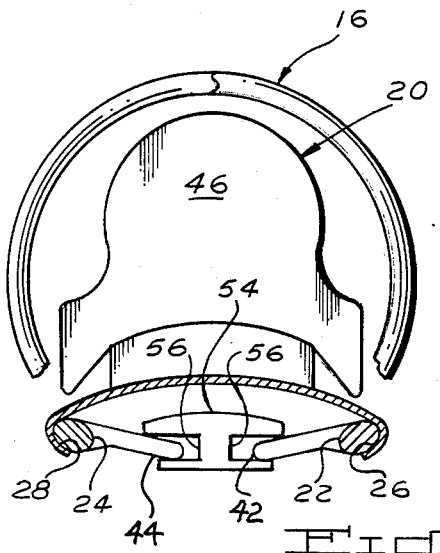
FIG. 4 is a cross sectional view along line 4—4 of FIG. 2.
Figure 5:
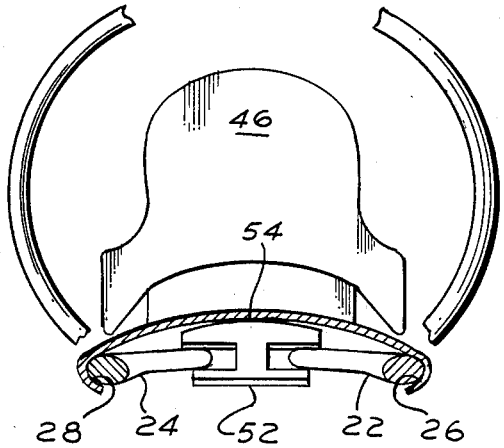
FIG. 5 is a view similar to FIG. 4 with the parts in different operating position.
Figure 6:
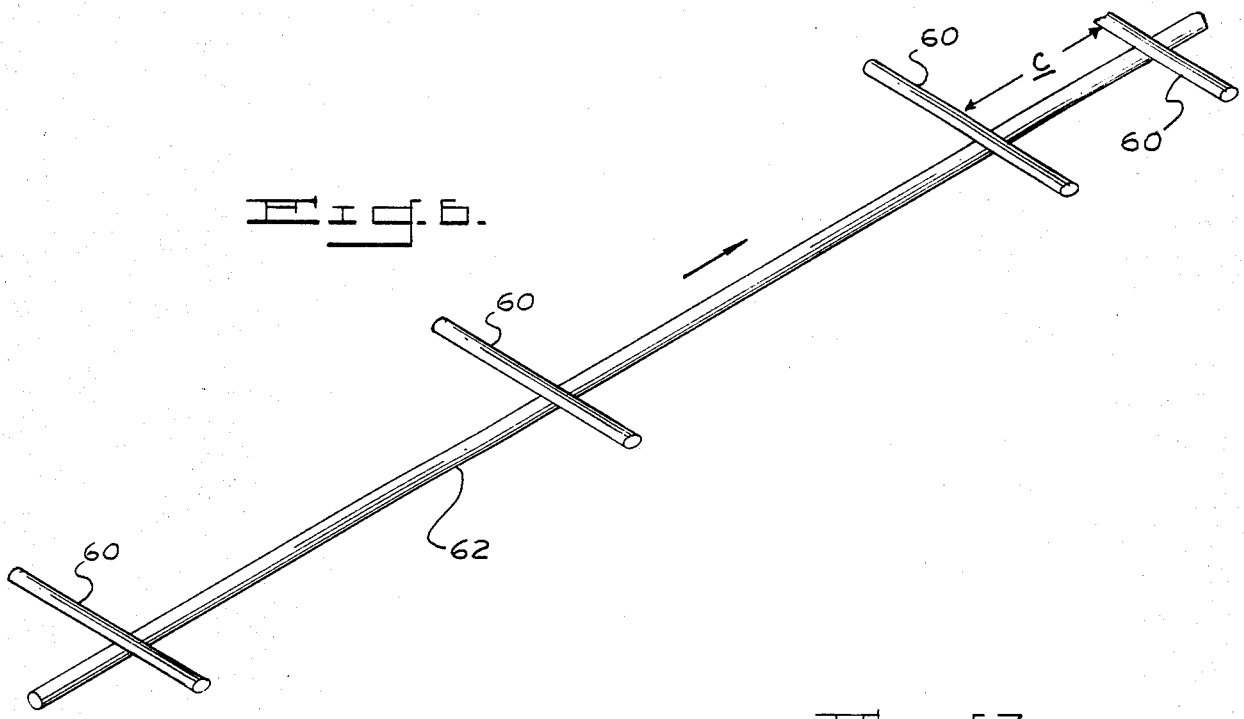
FIGS. 6–8 are views illustrative of the steps in the process of manufacture used to fabricate the rail and ring portion of the mechanism embodying this invention.

As best illustrated in FIGS. 2, 5 and 6, the ring mechanism embodying my invention comprises a pair of parallel rods or rails 22 and 24. The rails are preferably formed of a metallic material and are preferably elliptical or oval in cross section (FIGS. 4 and 5) for increased strength in the transverse direction. The rails 22 and 24 are disposed within the opposed edge channels 26 and 28, formed by inturned edges of the spring metal cover plate 18.

Affixed, such as by welding, at longitudinally spaced locations along each of the rails 22 and 24 are cooperative ring halves or segments 30 and 32 of identical construction, which when reversed one relative to the other, will form the split rings 16 of the binder. Each of the discrete segments 30 is affixed at a point along the rail 22 so as to register with a cooperative segment 32 affixed at a corresponding point on the other rail 24. The cover plate includes a plurality of spaced slots 25 (FIGS. 1 and 4) along the edges thereof to accommodate opening and closing of the ring segments. The side edges of these slots aid in holding the rails in longitudinally fixed positions and thus, maintain the ring segments in the same plane for pivotable movement when opening and closing the rings. The inner, lower end of ring segments 30 and 32 each includes a spade or flange 31 and 33 having a straight inner edge portion for about one half the width of the spade and for the other half, a small tab or tongue 34 and 36, which extends upwardly from the plane of the spade. The inner edges of these spades interfit with the tab 34 of one ring segment 30, abutting the straight edge portion of the mating ring segment 32 so that the ring segments, though not connected together are adapted to pivot open and closed as shown in FIGS. 4 and 5. The lower ends of the two ring segments 30 and 32 are urged toward and maintained in pivotable engagement by the arcuate spring metal cover plate 18. The upper ends of each ring segment is oppositely recessed to form mating joints 19 as illustrated in FIG. 2.

As depicted in FIG. 2, the larger dimension a of each oval rail lies at an oblique downwardly extending angle relative to a horizontal plane between the edge channels 26 and 28 of the cover plate when the rings are closed (FIG. 4). The arched portion of the cover plate 18 is in sufficient tension to urge and maintain the rails 22 and 24 and the ring segments 30 and 32 affixed thereto in their assembled and closed position. When the rings are fully opened, as illustrated in FIG. 5, the larger dimension a of the rails is disposed at an upwardly extending oblique angle. It will be recognized by those skilled in the art that during the opening movement of the rings 16, the lower limbs of the rings and the larger dimensions a of the rails will rotate through their dead center positions, that is, the position in which the larger dimensions of both rails, and the lower limbs of the ring segments lie approximately in a common plane transversely of the cover plate 18. In this coplanar rail position, the arched cover plate 18 will be in maximum tension so that in opening and closing the rings, it is necessary to apply sufficient force to overcome the maximum tension exerted by the cover plate 18. As the rails move past the dead center position, the ring segments, by a toggle type action, will be forcefully snapped to their fully opened or closed positions. This construction prevents inadvertent opening or closing of the rings. While the use of rails of oval cross section is preferred, it would be feasible to use rails of sufficient circular cross section, in which case, the tension in the cover plate would be varied entirely by the toggle action of the ring segments as disclosed in U.S. Pat. No. 3,404,685.

As discussed above, a booster or actuating lever 20 is disposed at each end of the ring mechanism, and serves both to open and close the rings by directly rotating the rails 22 and 24 about their longitudinal axes. As best illustrated in FIG. 2, the outer ends of each rail 22 and 24 include crank portions which curve inwardly in the manner of a pipe elbow from the straight and parallel inner portions of the rails and terminate in flanges or tangs 42 and 44 having flat or planar upper and lower surfaces generally parallel to the larger dimension a of the rail. These tangs provide means for coupling the rails to the booster levers for rotation of the rails 22 and 24 about their longitudinal axes in response to pivotable movement of the booster levers 20 about axes transverse to the axes of the rails.

The levers 20 at both ends of the ring mechanism include flange portions 46 of suitable size and shape to be grasped by the thumb and index finger. A step portion 47, to provide clearance for the ends of the loose leaf sheets, extends inwardly and downwardly from the lower end of the flange 26, and arms 48 extend outwardly from the outer lower edge portions of the step portion 47. The levers are pivotable about the arms 48, which are coupled to the cover plate 18 by crimping closed the outer ends of the channels 26 and 28, as illustrated at 50 in FIG. 4. The channel is also crimped to firmly engage portions of the rails inwardly of the tangs so that the rails will not be excessively bowed when the booster levers exert upward or downward forces on the crank portions of the rails. The lower end of each booster 20 includes a horizontal web portion 52 (FIGS. 2 and 5) and an upright T-shaped bar portion 54, which defines with the web 52 a pair of outwardly opening horizontal slots 56 (FIG. 4). The slots are dimensioned to receive therein the tangs 42 and 44 of the rails 22 and 24. With this arrangement, when the booster levers are pivoted outwardly or away from each other, the rings 16 are opened, and when the boosters are pivoted inwardly, the rings are closed. The pivotable movement of the booster levers is transmitted directly into rotational movement of the rails with resulting opening and closing movement of the ring segments. The upper edge of each T-bar 54 has a cylindrical upper edge of approximately the same radius as the arcuate cover plate 18. The curved edge of the T-bar serves as a mechanical stop to limit opening movement of the rings.

From the fulcrum of lever 20 provided by arms 48 to the point of engagement with the rail tangs 42 and 44 (FIG. 2) is a short distance, on the order of about 0.125 inches. Thus, only a relatively short lever is needed outwardly of the fulcrum to obtain a suitable mechanical advantage for easy operation of the rings.

Figure 7:
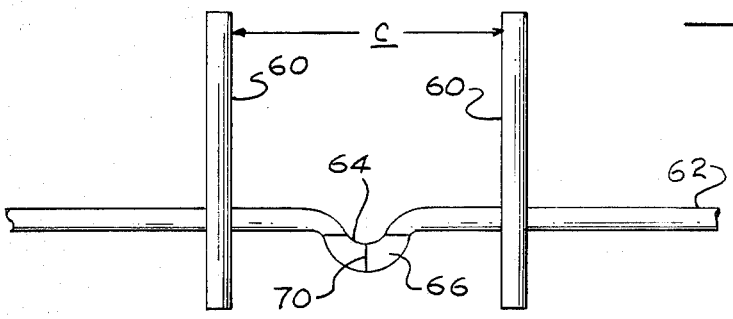
Figure 8:
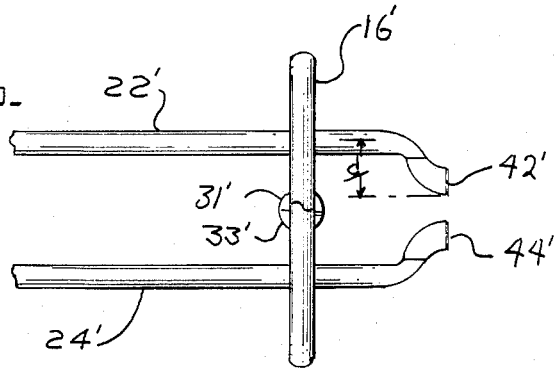

In FIGS. 6–8 are illustrated the manufacturing steps by which the rail and ring components embodying this invention are fabricated in a continuous process. First, the ring segments 60 are affixed, such as by welding at spaced locations along a metallic rod 62, which is intermittently advanced for a novel sequence of manufacturing steps. The rod has a hardness as drawn and is preferably ovalized before the cross wires are attached.

The cross wires 60 are preferably supplied from a number of spools of annealed wire of indefinite length. For a three ring binder, three spaced parallel wires are welded onto the rail wire 62 and simultaneously cut to ring-forming length as shown in FIG. 6. The rail wire is then advanced a given distance for the next welding operation of three additional cross wires 60. An interval or distance c of about 2 inches between adjacent sets of three cross wires is selected to provide for two crank portions with operating tangs 42 and 44 to be formed therebetween.

As one set of cross wires is being welded to the rail, a length of the rail, which may be about one inch in the interval c is inductively heated to anneal the same for metal forming operations. The annealed section is next advanced to a forming station, where it is hot formed as illustrated in FIG. 7 in a coin die. The interval c between adjacent rail sections is held fixed during the forming operation, and a portion of the rail is laterally displaced to form a U-shaped loop 64, having a radius of curvature so that the bottom of the loop is offset a substantial distance d from the longitudinal axis of the rail 62. At the same station, the bottom of the loop 64 is flattened to form a flange 66 having planar upper and lower surfaces.

The next step in the process is to quarter bend the longer ends of the cross wires 60 and form the spade area on the opposite ends of the cross wire 60 in a coin die. The spade areas are the trimmed and the hook joint 19 (FIG. 2) is formed, followed by the final bending of the cross wires to ring form and the bending of the tabs 34 on the spade portions. Finally, the completed leading section of the rail wire is severed along a line 70 (FIG. 7), equidistant from the adjacent rails 60. By this intermittent, but continuous process, a plurality of identical rail wires 22' and 24', with mating ring segments 16' are fabricated as illustrated in FIG. 8. As shown, each rail has three identical ring segments and crank arm portions with operating tangs 42' and 44' on opposite ends thereof. To assemble a ring mechanism, two identical units of rail and ring segments are simply reversed in end-to-end relation with their spade ends 31' and 33' pivotably engaged and assembled with a cover plate 18 and pair of booster levers 20. The ends of the cover plate are crimped as described above to hold the rails and the booster levers in assembled relation.

Having thus disclosed this invention, what is claimed is:

1. Ring mechanism for looseleaf ring binders comprising an arcuate spring metal cover plate having inturned, opposing edge channels, a pair of parallel, spaced metallic rails, oval in cross-section, rotatably disposed within the channels and each having a plurality of mating ring segments affixed on said rails at corresponding spaced locations and forming the rings of said binder, the outer ends of said rails including angularly offset crank arm portions, each having laterally and axially extending tang portion having opposed, generally planar surfaces at its outer end and a pivotable operating lever disposed at each end of the cover plate, said lever having spaced opposed portions coupled with the planar surfaces of said tangs to rotate said rails selectively in opposite directions and thereby carry said ring segments toward and away from each other both to open and close said rings, using said operating lever.

2. Ring mechanism as set forth in claim 1 in which said planar surfaces on each rail are generally parallel to the larger cross sectional dimension of said rail.

3. Ring mechanism as set forth in claim 1 in which said operating levers each include laterally extending arm portions, defining axes about which the levers are pivotable, said axes being perpendicular to the longitudinal axes of said rails, the inner ends of said levers including slots engaging said the planar surfaces of said tangs for transmitting the pivotable movement of the levers to said rails whereby the rails are longitudinally rotated.

4. Ring mechanism as set forth in claim 3 in which slots are defined by an upstanding T-bar on the inner end of each operating lever, the upper edge of said bar having a curved surface which conforms with the curvature of the cover plate and serves as a stop member for limiting the extent of opening movement of the rings of said mechanism.

5. Ring mechanism as set forth in claim 3 in which said arm portions of the operating levers are pivotably disposed adjacent the ends of the cover plate edge channels and retained therein by crimping of the outer ends of said channels.

* * * * *

UNITED STATES PATENT AND TRADEMARK OFFICE

CERTIFICATE OF CORRECTION

PATENT NO. : 4,522,526

DATED : June 11, 1985

INVENTOR(S) : ARTHUR LOZEAU and WILLIAM H. LUCEY

It is certified that error appears in the above-identified patent and that said Letters Patent is hereby corrected as shown below:

Page 1, after "Inventors:"

"Lozfau" should read: "Lozeau"

Signed and Sealed this

*Twenty-fourth* Day of *September 1985*

[SEAL]

*Attest:*

DONALD J. QUIGG

*Attesting Officer*

*Commissioner of Patents and Trademarks—Designate*